US006233989B1

(12) United States Patent
Blinstrubas

(10) Patent No.: US 6,233,989 B1
(45) Date of Patent: May 22, 2001

(54) METHOD AND APPARATUS FOR STAMPING A METAL SHEET WITH AN APERTURED DESIGN HAVING ROLLED EDGES

(75) Inventor: Raymond Z. Blinstrubas, Darien, IL (US)

(73) Assignee: Changing Paradigms, LLC

( * ) Notice: Subject to any disclaimer, the term of this patent is extended or adjusted under 35 U.S.C. 154(b) by 0 days.

(21) Appl. No.: 09/687,375

(22) Filed: Oct. 13, 2000

(51) Int. Cl.[7] ..... B21D 28/18

(52) U.S. Cl. ..... 72/55; 72/325; 72/465.1; 72/466.8

(58) Field of Search ..... 72/55, 325, 465.1, 72/466.8

(56) References Cited

U.S. PATENT DOCUMENTS

| | | | | |
|---|---|---|---|---|
| 1,429,590 | | 9/1922 | Jones . | |
| 2,377,664 | * | 6/1945 | Berger | 72/55 |
| 3,557,446 | * | 1/1971 | Charschan | 72/55 |
| 3,611,765 | * | 10/1971 | Harvey | 72/55 |
| 3,678,577 | * | 7/1972 | Weglin et al. | 72/55 |
| 3,683,735 | * | 8/1972 | Achler et al. | 72/55 |
| 3,888,841 | | 6/1968 | McHardy et al. | 222/548 |
| 3,986,379 | | 10/1976 | Mansell | 72/57 |
| 4,509,358 | * | 4/1985 | Krowl | 72/766.8 |
| 4,574,445 | * | 3/1986 | Bentin et al. | 72/465.1 |
| 4,601,189 | | 7/1986 | Langenhorst | 72/326 |
| 4,748,837 | | 6/1988 | Kurosawa et al. | 72/63 |
| 4,765,166 | | 8/1988 | Bergman et al. | 72/63 |
| 4,770,015 | | 9/1988 | DeSmet | 72/57 |
| 4,829,807 | | 5/1989 | Nacke | 72/465 |
| 5,016,458 | | 5/1991 | DeSmet | 72/57 |
| 5,255,550 | | 10/1993 | Dittlo | 72/57 |
| 5,272,898 | | 12/1993 | Dittlo et al. | 72/57 |
| 5,361,617 | | 11/1994 | Dittlo | 72/57 |
| 5,460,787 | | 10/1995 | Colon | 422/123 |
| 5,755,129 | | 5/1998 | Yamasaki | 72/57 |
| 6,029,486 | | 2/2000 | Haraga et al. | 72/57 |

* cited by examiner

*Primary Examiner*—David Jones
(74) *Attorney, Agent, or Firm*—Wood, Herron & Evans, L.L.P.

(57) ABSTRACT

A metal container lid having an apertured design with rolled edges is stamped by a method and apparatus incorporating a cushioning pad between a die and the metal sheet, which is then stamped with a perforating punch.

17 Claims, 2 Drawing Sheets

METHOD AND APPARATUS FOR STAMPING A METAL SHEET WITH AN APERTURED DESIGN HAVING ROLLED EDGES

FIELD OF THE INVENTION

The present invention relates generally to a method and apparatus for forming metal sheets, and more particularly to a stamping method for punching an apertured design through a metal container lid.

BACKGROUND OF THE INVENTION

Numerous industrial, mechanical and household products require that patterns be cut into their metal surfaces. Included among such applications are metal lids that permit the diffusion of scented air from a container through a cut-out design. Such designs are commonly stamped through the top wall of the lids by a punch press apparatus. A typical press includes a die and a punch that is hydraulically moved along an axis perpendicular to the die. The punch features raised portions that mate with corresponding recesses in the punch. The mating surfaces of the die and punch correspond to the apertured design required for a given application.

During stamping, the mating portions of the die and punch shear through an interposed metal lid or sheet. More specifically, the metal workpiece is placed directly onto the die prior to stamping. As the punch is lowered and made to mate with the die, it cuts through the metal sheet as disclosed in U.S. Pat. No. 3,388,841. Elastic or laminate layers are optionally positioned between the punch and the metal workpiece to absorb tensile stresses incurred by the metal and die. Such a configuration is disclosed in U.S. Pat. No. 4,829,807.

Conventional stamping methods such as those above cause sharp edges to be formed along their stamped designs. Such exposed edges present safety concerns to assemblers and consumers. Further, known stamping techniques severely weaken the structural integrity of the lids by cutting away supportive portions of metal. Consequently, designs requiring a substantial portion of the lid to be removed are not feasible. Thus, in applications such as are described above, there is a need for an apparatus and method for stamping apertured designs into metal without substantially weakening the metal surface and exposing sharp edges.

SUMMARY OF THE INVENTION

This invention is directed to a method and apparatus for stamping a metal sheet with an apertured design. According to the invention, a cushioning pad is placed onto a die and metal sheet is positioned between the pad and a perforating punch that is operable to mate with the die. The punch is used to cut through the metal sheet and pad to stamp the metal sheet with the design and roll the metal edges of the design.

The cushioning pad is made of vegetable or polymeric fibers and is of variable thickness. For example, polyester, polyamide (aramid) and treated paper fibers bound with nitrite, neoprene and SBR are particulary effective. The apertured design may embody any polygonal or decorative shape, including a swirl pattern. Significantly, the edges of the apertured design are rolled over to reinforce the metal and to avoid sharp cutting surfaces.

The present invention is especially used to stamp a metal container lid with an apertured design having curled edges with superior strength characteristics as compared with lids that have flat-cut edges. For example, a swirl design with rolled edges provides a functionally effective and aesthetically pleasing design for dispensing aroma through the apertures. Additional features of the metal container lid include an absence of sharp edges on the top surface of the cap, as well as enhanced strength characteristics. Thus, more material may be cut out of the metal surface without sacrificing the integrity of the lid.

The above and other objects and advantages of the present invention will be made apparent from the accompanying drawings and the description thereof.

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

The present invention cushions a metal sheet from the back side that is being punched with an apertured design by positioning a cushioning pad between a die and the metal sheet. The cushioning pad is made of a compressible material, preferably made of vegetable or polymeric fibers. The pad serves to cushion the metal sheet from beneath, forming a bent or rolled surface at the perforated edges of the apertured design. The metal sheet is preferably made of tin plate. However, other metal sheet materials such as steel, metal alloys, aluminum, or the like can be used. The metal sheet thicknesses can vary and, in general, range from about 0.01 inch to about 0.50 inch. The pad can have thicknesses of about 0.015 inch to about 0.07 inch when metal sheet of above thicknesses and, preferably tin plate, is being stamped.

Figure 1:
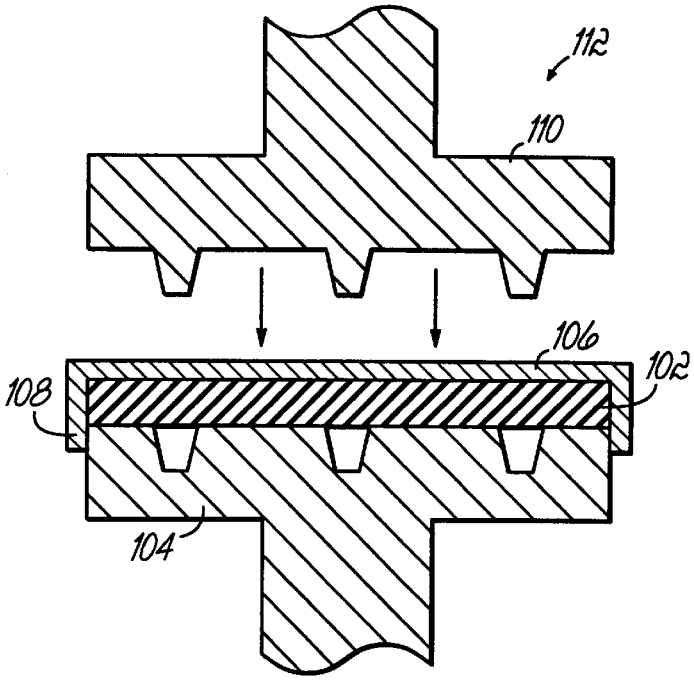
FIG. 1 is a cross-sectional view of a punch press that is consistent with the principles of the present invention.

More specifically, the cushioning pad 102 is first placed onto the steel die 104 of FIG. 1. In one embodiment, the cushioning pad 102 is attached to the die 104 with epoxy or some other suitable fastening means. The metal sheet 106, represented in FIG. 1 as a container lid, is then positioned onto the die 104 so that the threaded side walls 108 of the lid extend over the cushioning pad 102. The perforating punch 110 of the punch press 112 is then lowered onto the top surface of the metal sheet 106 with a force sufficient to perforate both the sheet 106 and the cushioning pad 102 in a desired apertured design.

As the perforating punch 110 is lowered onto the die 104, it penetrates through the metal sheet 106 and continues on through the cushioning pad 102 until it reaches the impenetrable surface of the die 104. As the punch 110 perforates the metal sheet 106, the force from the punch action rolls the perforated edges of the sheet 106 downward into the cushioning pad 102. The thickness and composition of the cushioning pad 102 may be varied to effect the desired degree of rolling. The dynamics of the pad 102 and sheet are such that a cushioning pad 102 of about 1/64" thickness made of vegetable or polymeric fibers and a suitable binder creates an optimum rolled apertured edge. For example, polyester, aramid and paper fibers bound with a nitrite, neoprene or SBR binders are particularly effective in facilitating a desirable rolled effect. In the preferred embodiment, the specifications of the cushioning pad are:

Meets HHP 96 Type 1; MIL-G-12803 (ORD) Type III, Class 2. Group 1: ASTM D 1170-62; and P3313. Operating temperature range is −20° to +250° F. Maximum pressure is 300 psi. Color is tan.

The perforating punch 110 is then hydraulically or mechanically raised from the die 104 so that the metal sheet 106 may be retrieved. The cushioning pad 102 may be reused or replaced depending upon the degree of deformation incurred by the pad 102 during the perforating process. The stamped metal sheet 106 product features an apertured design corresponding to the pattern on the die 104. Significantly, the edges of the apertured design are rolled downward.

Figure 2:
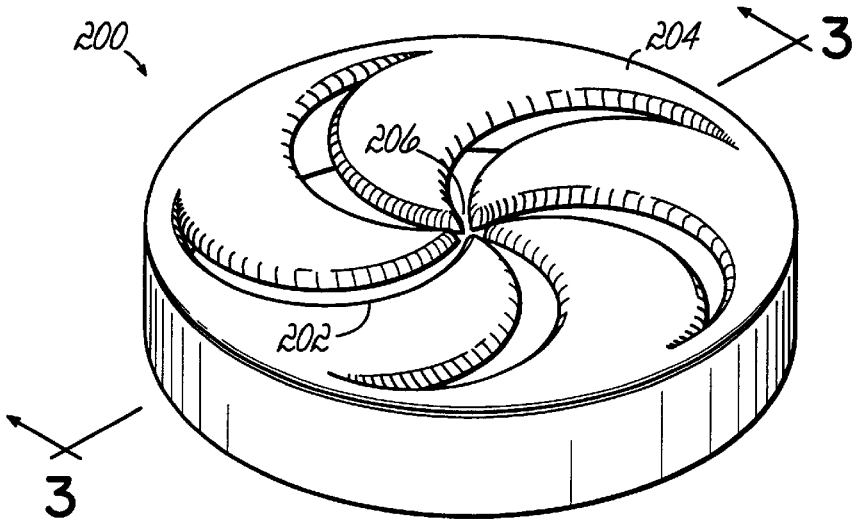
FIG. 2 is a perspective view of a metal container lid manufactured in accordance with the principles of the present invention.
Figure 3:
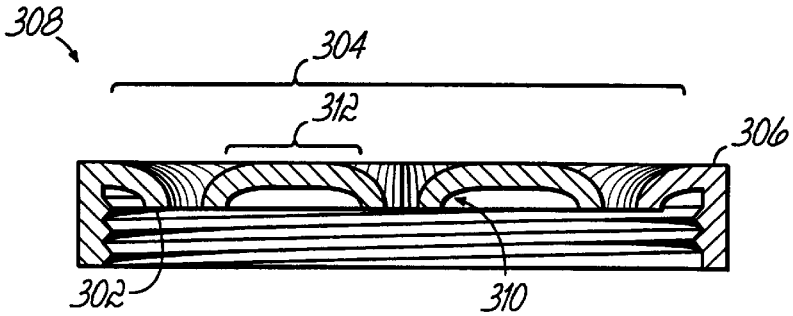
FIG. 3 is a cross-sectional view of the metal container lid of FIG. 2, taken on lines 3—3.

An exemplary product of the above apparatus is illustrated in FIGS. 2 and 3. The depicted metal container lid 200 has a swirl design 202 stamped through its top surface 204. The lid 200 is reusable and threaded so as to seal a mating container. The exemplary swirls of the perforated design 202 extend concentrically outward from the center 206 of the metal lid 200. As shown more clearly in the cross-sectional view of FIG. 3, the edges 302 of the perforated design 304 are bent, or rolled downward from the top 306 of the lid 308. The downward orientation of the edges 302 prevents users of the product from cutting themselves when contacting the top 306, exposed surface of the lid 308.

The downward orientation of the aperture edges 302 additionally serves to reinforce the top 306 surface of the metal lid because they remain connected and unbroken along the apertured design 304. Thus, the rolled edges 302 communicate vertical and tangential support to the metal lid 308 via the continuous edges 302 of the apertured design 304. Additionally, less supportive metal is cut away from the container lid 308. Whereas a conventional stamping method design shears away all of the metal surrounding the aperture pattern 304, the present invention leaves a portion of the metal intact and merely rolled back away from the aperture design.

Additional forming effects realized by the present invention are also shown in FIG. 3, including a slight tapering 310, or elongation of the rolled edges 306. Such an effect is useful in applications requiring subtle control of fluid flow through the perforated design. Another embodiment in accordance with the invention calls for the portion 312 of the metal lid 308 adjacent the perforated design 304 to be slightly bowed or raised. This raised portion 312 lends a rounded, contoured appearance to the lid top 306 that is desirable for aesthetic reasons. The contoured surface can additionally be modified to functionally decrease the frictional angle of incidence relative to the flow of fluid over and through the lid 308. Such flowrate control is advantageous in forced air or heat dissipation applications that use, for instance, a stamped metal vent. The desired degree of both the tapering and rounding effects is predetermined as a function of the thickness and composition of the cushioning pad.

Figure 4:
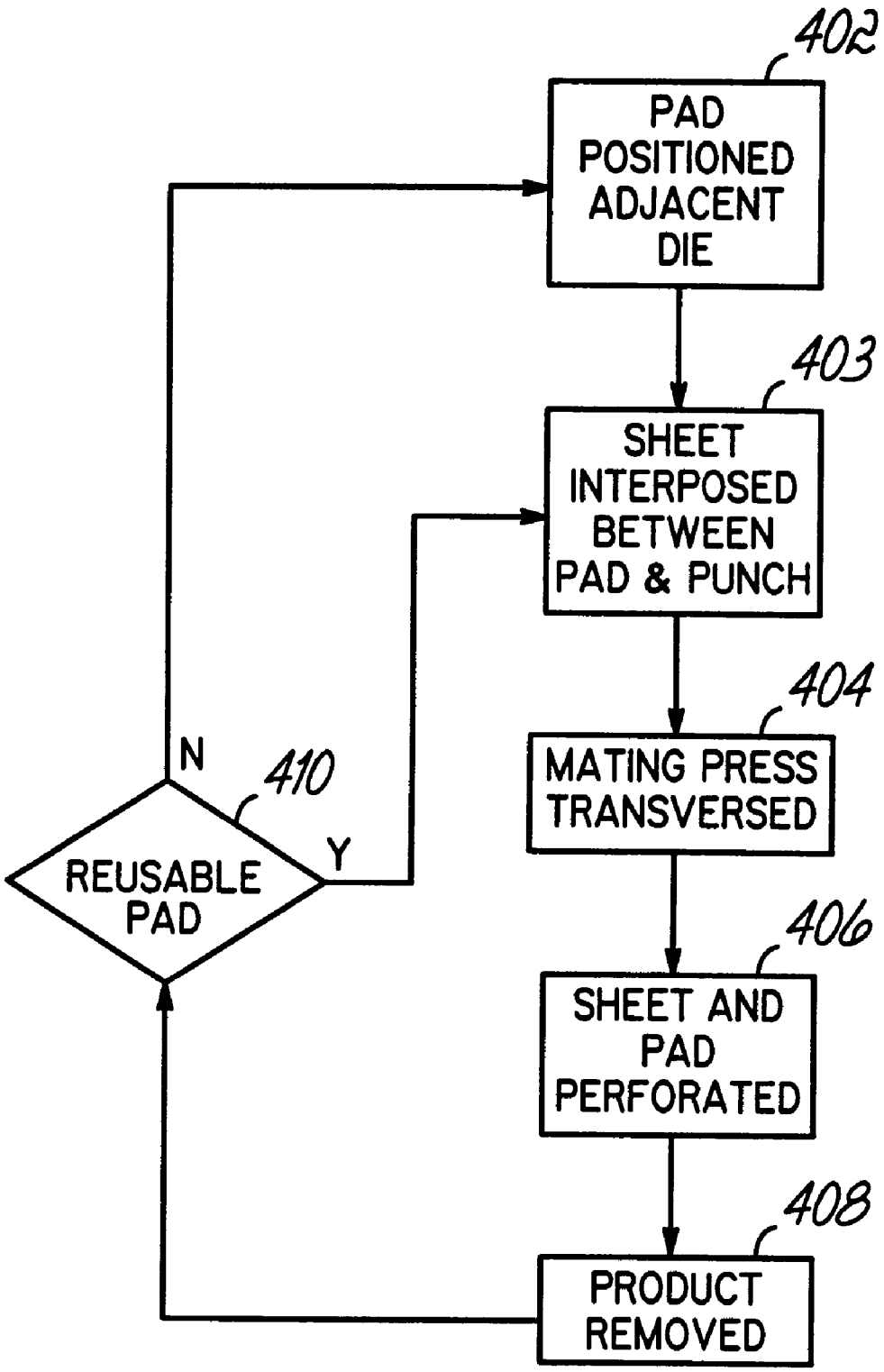
FIG. 4 is a flowchart consistent with the principles of the present invention.

FIG. 4 is flowchart outlining the basic steps involved in creating a perforated apertured design in accordance with the principles of the invention. At block 402, a cushioning pad is positioned between a die and a perforating punch operable to mate with the die. The cushioning pad may be adhesively secured to the die and is removable. A metal sheet is interposed in between the cushioning pad and the perforating punch at block 403.

Depending upon the configuration of the punch press, the perforating punch is lowered or raised until it contacts the surface of the metal sheet at block 404. The perforating punch stamps an apertured design in both the metal sheet and the underlying cushioning pad at block 406. The progress of the perforating punch is halted upon contacting the mating surface of the die. Alternatively, the progress of the punch may be stopped immediately after perforating the metal sheet and prior to cutting the cushioning pad, if an uncut pad is required for reuse.

At block 408, the perforating punch is backed away from both the die and cushioning pad so that the metal sheet product may be removed. The dynamics of the cushioning pad being positioned between the sheet and die results in the metal sheet having an apertured design with rolled edges and superior strength characteristics. The stamping procedure may then be repeated for another metal sheet at block 403. Alternatively, if the cushioning pad must be replaced after the perforating procedure, then a new pad is positioned adjacent the die at block 402.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A method for stamping a metal sheet with an apertured design comprising:

providing a perforating punch and a die operable to mate with the punch and to stamp an apertured design through a metal sheet;

placing a cushioning pad on the die;

positioning the metal sheet between the cushioning pad and the punch;

using the punch to cut through the metal sheet and pad to stamp the metal sheet with the apertured design and roll the metal edge of the apertured design.

2. A method for stamping a metal sheet with an apertured design according to claim 1, wherein the metal sheet is tin plate and the cushioning pad is made from vegetable, polyester, aramid and paper fibers bound by nitrite, neoprene and SBR binder.

3. A method for stamping a metal sheet with an apertured design according to claim 1, wherein the thickness of the cushioning pad is about 0.015 inch to about 0.07 inch for metal sheet thicknesses of about 0.01 inch to about 0.07 inch.

4. A method for stamping a metal sheet with an apertured design according to claim 1, wherein the apertured design selectively embodies a polygonal or a decorative shape.

5. A method for stamping a metal sheet with an apertured design according to claim 1, wherein the apertured design embodies a swirl pattern.

6. A method for stamping a metal sheet with an apertured design according to claim 1, wherein the perforating punch and the die are constructed from steel, the metal sheet is tin plate and the cushioning pad is made from a fiber material selected from the group consisting of vegetable fibers and polymeric fibers.

7. A method for stamping a metal sheet with an apertured design according to claim 1, further comprising reusing the cushioning pad with the further step of stamping the apertured design through another metal sheet.

8. An apparatus for perforating a metal sheet comprising:

a perforating punch operable to stamp an apertured design through a metal sheet;

a die operable to mate with the perforating punch;

a cushioning pad interposed between the mating surfaces of the die and the metal sheet for providing a rolled over edge of the apertured design through the metal sheet.

9. An apparatus for perforating a metal sheet according to claim 8, wherein the cushioning pad is made from vegetable, polyester, aramid and paper fibers bound by nitrite, neoprene and SBR binder.

10. An apparatus for perforating a metal sheet according to claim 8, wherein the thickness of the cushioning pad is about 0.015 inch to about 0.07 inch for metal sheet thicknesses of about 0.01 inch to about 0.07 inch.

11. An apparatus for perforating a metal sheet according to claim 8, wherein the punch and mating die provide an apertured design of a concentric swirl pattern.

12. An apparatus for perforating a metal sheet according to claim 8, wherein the perforating punch and the die are constructed from steel, and the cushioning is made from a fiber material selected from a group consisting of vegetable fibers and polymeric fibers.

13. An apparatus for perforating a metal sheet according to claim 8, wherein the cushioning pad is reusable.

14. A metal container lid having an apertured design comprising a metal sheet having stamped therethrough an apertured design, said design having the edge rolled over to reinforce the lid and avoid a sharp cutting surface.

15. A metal container lid having an apertured design according to claim 14, wherein the aperture design comprises a swirl pattern.

16. A metal container lid having an apertured design according to claim 14, wherein the metal sheet is tin plate.

17. A metal container lid having an apertured design according to claim 14, wherein the thickness of the metal sheet is about 0.01 inch to about 0.07 inch.

* * * * *